US008136176B2

(12) United States Patent
Shebek et al.

(10) Patent No.: US 8,136,176 B2
(45) Date of Patent: Mar. 20, 2012

(54) SKIMMER VENT FOR POOL WITH POOL COVER OR POOL LINER

(75) Inventors: Michael J. Shebek, Carmel, IN (US); Michael F. Shadoan, Fishers, IN (US)

(73) Assignee: Automatic Pool Covers, Inc., Fishers, IN (US)

( * ) Notice: Subject to any disclaimer, the term of this patent is extended or adjusted under 35 U.S.C. 154(b) by 1140 days.

(21) Appl. No.: 11/949,484

(22) Filed: Dec. 3, 2007

(65) Prior Publication Data

US 2009/0139019 A1 Jun. 4, 2009

(51) Int. Cl.
*E04H 4/00* (2006.01)

(52) U.S. Cl. ..... 4/490; 4/496; 4/506; 210/167.1

(58) Field of Classification Search ..... 4/209 R, 4/490, 496, 506; 210/167.1, 167.18, 188; 454/48

See application file for complete search history.

(56) References Cited

U.S. PATENT DOCUMENTS 5,293,652 A * 3/1994 Furr ..... 4/498
6,018,824 A * 2/2000 Pearson ..... 4/213
6,168,514 B1 * 1/2001 Weston ..... 454/48
6,387,252 B1 * 5/2002 Desjoyaux et al. ..... 210/167.12

* cited by examiner

*Primary Examiner* — William Gilbert
*Assistant Examiner* — Patrick Maestri
(74) *Attorney, Agent, or Firm* — Taylor IP, P.C.

(57) ABSTRACT

The present invention involves a pool system including ventilation for offending gases from the pool.

3 Claims, 1 Drawing Sheet

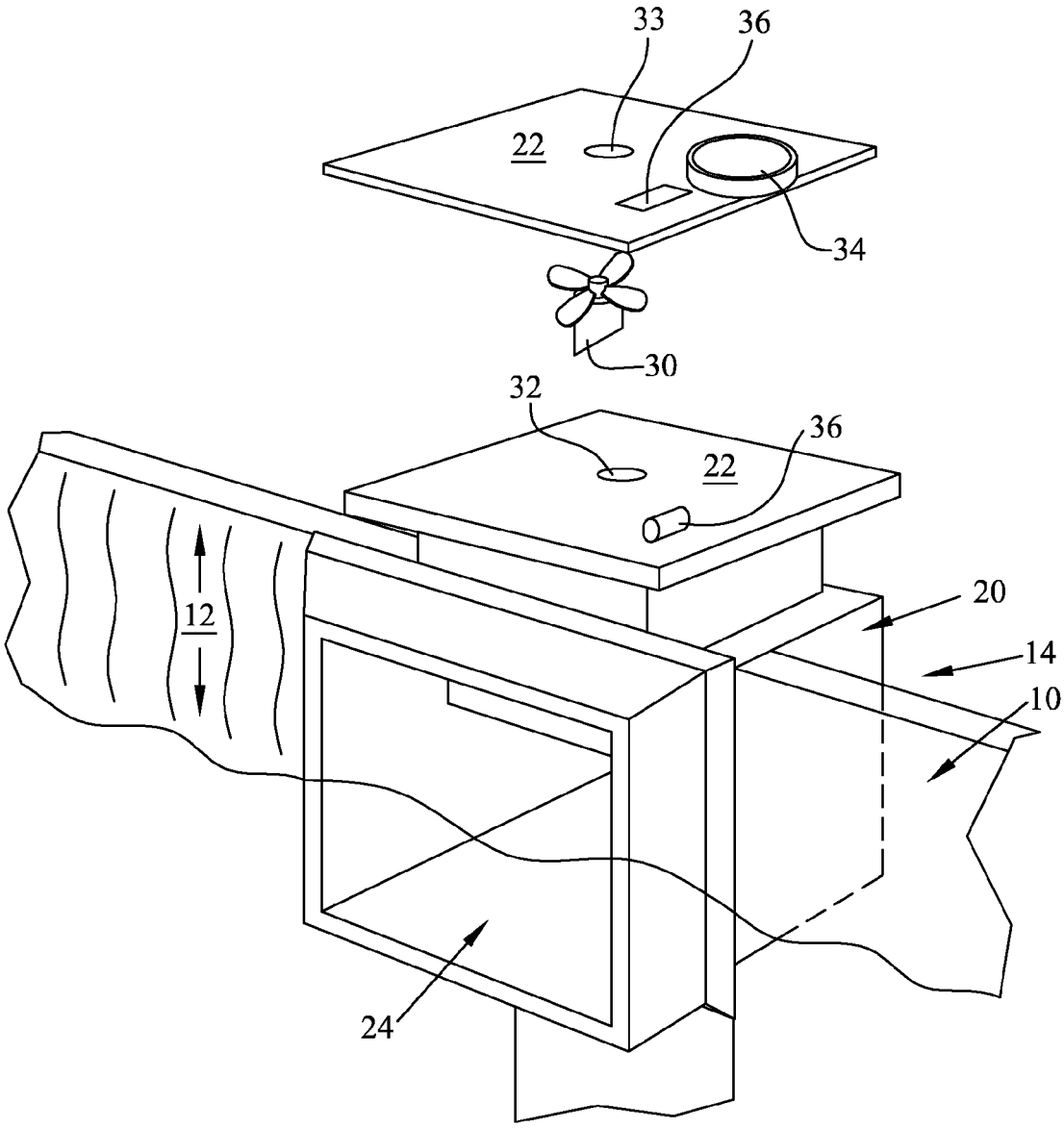
33
36
22
34
30
32
36
22
12
20
14
10
24

SKIMMER VENT FOR POOL WITH POOL COVER OR POOL LINER

BACKGROUND OF THE INVENTION

1. Field of the Invention

The invention relates to pools that have pool covers or pool liners. More specifically, the field of the invention is that of skimmer facilities for existing pools having pool covers or pool liners.

2. Description of the Related Art

The approaches described in this section could be pursued, but are not necessarily approaches that have been previously conceived or pursued. Therefore, unless otherwise indicated herein, the approaches described in this section are not teachings or suggestions of the prior art to the claims in this application and are not admitted to be prior art by inclusion in this section.

Pools are generally constructed by pouring concrete in the ground and creating a depression which becomes the pool when filled with water. However, rather than have the water reside directly on the concrete surface, pool liners are used to contain the water. The pool liners are generally made of water impermeable material (e.g., vinyl) held in place by a track system that is located at the top of the pool near the surface of the water. Many pools also have an automatic pool cover that provides a tarp connected with the track system. The tarp is connected to a motor so that the tarp may be automatically closed to prevent entry, or opened to allow use of the pool.

Chlorine is typically used in pools for pool sanitation. Without the use of a disinfectant, swimming pool water may contain pathogens, such as bacteria or viruses, which may spread diseases and pathogens between pool users. Chemical disinfectants including chlorine related chemicals make pool water inhospitable to pathogens.

Several forms of chlorine related chemicals may be used such as hypochlorous acid, sodium hypochlorite, also known as household bleach, and chlorinated isocyanurates. Irregardless of the form of chlorine in water, it is possible that chlorine gas ($Cl_2$) may be provided to the environment around the pool by such sources as the chlorinating source as well as by the chlorine that is present in the pool.

Chlorine gas may be provided and therefore present around the pool including gas areas alongside the pool walls. Chlorine gas possibly can be absorbed within materials such as vinyl including the pool liner or pool cover. Chlorine gas absorbed within a vinyl material may then distort the pool liner or pool cover by such methods as hydrostatic forces. Furthermore, the distortions may allow water through the pool liner or pool cover, further distorting the pool liner or pool cover by such methods as hydrostatic forces. Distortion may cause sagging of the pool liner or pool cover. Such sagging may cause damage to the vinyl or the pool.

It is also possible that other offending gases such as other chlorine related compounds may cause the same hydrostatic forces. The offending gases may cause similar sagging of the pool liner or pool cover due to effects such as hydrostatic forces as previously described. Furthermore it is also possible that the offending gases may cause similar damage to the vinyl or pool.

As pool liners and automatic pool covers are desired for several reasons, it is important to maintain the pool covers and liners to thus solve the problem of sagging pool covers or sagging pool liners and the resulting damages.

SUMMARY OF THE INVENTION

The present invention is a venting system and method which allows for the use of existing pool structures to vent and remove the offending gases, by locating a fan in the skimmer structure.

The present invention, in one form, relates to a pool system including a pool basin having a top periphery and a water containing portion disposed below the top periphery; a track system disposed proximate the top periphery of the pool basin; a liner disposed in the water containing portion of the pool basin and connected to the track system; a skimmer system in communication with the water containing portion of the pool basin, said skimmer system including a passageway in communication with the water containing portion of the pool basin, the passageway having a removable lid allowing for access to the skimmer system; and a fan coupled to the removable lid, the fan structured and arranged to vent the passageway through the removable lid.

The present invention, in another form, relates to a lid for a skimmer of a pool, the lid adapted to be disposed in an opening allowing access to the skimmer from outside of the pool, the lid including a plate having a shape generally corresponding to the opening, the plate defining an aperture; a fan connected to the plate and oriented to project air flow through the aperture; and a power source coupled to the fan.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 1 is an exploded view of a skimmer vent using the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates an embodiment of the invention, in one form, and such exemplifications are not to be construed as limiting the scope of the invention in any manner.

DESCRIPTION OF EMBODIMENTS OF THE PRESENT INVENTION

The embodiment disclosed below is not intended to be exhaustive or limit the invention to the precise form disclosed in the following detailed description. Rather, the embodiment is chosen and described so that others skilled in the art may utilize its teachings.

Referring to FIG. 1, a portion of a pool is illustrated. More specifically, pool wall 10 is illustrated. As illustrated the pool includes a water containing portion. In this illustrative embodiment, pool wall 10 is a portion of the water containing portion. Also illustrated is water within the water containing portion of the pool.

The pool including pool wall 10 includes, among other things, a pool liner (not shown) that is used to contain the water within the pool. Furthermore, pool wall 10 is adjacent to or encloses a pool track (not shown) upon which a pool cover (not shown) is at least partially disposed. As illustrated in FIG. 1, there is an area between the water in the pool and the top surface of the pool wall. This area has been illustrated as gas area 12. Gas area 12 may include chlorine gas as well as other offending gases such as chlorine related gases. It is likely that chlorine gas or other offending gases may damage vinyl materials such as the pool liner or the pool cover.

FIG. 1 also illustrates skimmer system 14. As illustrated, skimmer system 14 is at least partially located along pool wall 10. As illustrated, skimmer system 14 is partially in contact with the water as well as gas area 12. Skimmer system 14 may include body 20 and lid 22. More specifically, body portion 20 may be at least partially in contact with the water as well as the gas area. Furthermore, body portion 20 defines cavity 24.

Lid portion 22 may be partially located within gas area 12 or above pool wall 10. As illustrated, cavity 24 is in fluid communication with the water and gas area 12. As illustrated, lid 22 is coupled to body 20 and in communication with cavity 24.

As illustrated in the present disclosure, skimmer system 14 may include fan 30. In this illustrative embodiment, fan 30 is associated with lid 22 of skimmer system 14. Lid 22 may define passageway 32. Passageway 32 is in fluid communication with gas area 12, cavity 24, as well as outside of the pool area. Passageway 32 may be configured to move gas out of gas area 12 and to the outside of the pool area.

In this illustrative embodiment, fan 30 is located in communication with gas area 12 and cavity 24. Fan 30 is configured to push air through skimmer system 14 and outside of gas area 12. Fan 30 may be placed in numerous locations including outside of skimmer system 14. Fan 30 may be structured and arranged to push or pull gas out of gas area 12.

Removal of gas from gas area 12 may be performed by many different methods including draining chlorine gas or chlorine related gases out of gas area 12. For example, draining the offending gas may occur by providing a lower position for a gas outlet since the offending gases such as chlorine gas are denser than air. Another method of removing gas involves providing a pressure deferential between gas area 12 and the area outside of gas area 12, providing a lower pressure to outside of gas area 12.

As illustrated in FIG. 1, fan 30 may be powered by solar power collector 34 or a battery (not shown). Fan 30 may also include on/off switch 36. Fan 30 may also be coupled to a timing system (not shown) for scheduled operation. Fan 30 may also be coupled to a thermometer based control device (not shown). Fan 30 may also be configured to increase operation time, velocity, or speed with increased temperature. Fan 30 may could also be configured with a sloping wall around aperture 32 to provide water resistance.

Skimmer system 14 may also include fan cap (not shown). Optionally, fan 30 includes the cap to prevent water from reaching fan 30. Fan 30 and optionally the cap, lid 22 or other accessories may also be part of a package to retrofit existing skimmer systems or pools.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A pool system comprising:

a pool basin having a top periphery and a water containing portion disposed below the top periphery;

a track system disposed proximate the top periphery of the pool basin;

a liner disposed in the water containing portion of the pool basin and connected to the track system;

a skimmer system in communication with the water containing portion of the pool basin, said skimmer system including a passageway in communication with a gas containing portion of the pool basin, the passageway having a removable lid allowing for access to the skimmer system; and a fan coupled to the removable lid, the fan structured and arranged to vent the passageway through the removable lid.

2. A swimming pool, comprising:

a skimmer including an opening and a lid assembly, the opening allowing access to the skimmer from outside of the swimming pool, the lid assembly including a plate, a fan, and a power source, the plate forming a lid which is disposed in the opening, the lid having a shape generally corresponding to the opening, the lid defining an aperture, the fan being connected to the lid and oriented to project air flow through the aperture, the power source being coupled to the fan.

3. The swimming pool according to claim 2, wherein the skimmer is configured for being accessed at least one of (a) on top of a deck of the swimming pool, and (b) while a pool cover is covering water in the swimming pool.

* * * * *